US007578108B2

(12) United States Patent
Swanson

(10) Patent No.: US 7,578,108 B2
(45) Date of Patent: Aug. 25, 2009

(54) TOP DOWN TRAP LOCK SHINGLE SYSTEM FOR ROOFS

(76) Inventor: Lief Eric Swanson, 3085 Mariners Way, Vero Beach, FL (US) 32963

( * ) Notice: Subject to any disclaimer, the term of this patent is extended or adjusted under 35 U.S.C. 154(b) by 0 days.

(21) Appl. No.: 11/960,880

(22) Filed: Dec. 20, 2007

(65) Prior Publication Data

US 2009/0158685 A1 Jun. 25, 2009

(51) Int. Cl.
*E04D 11/02* (2006.01)

(52) U.S. Cl. ..... 52/540; 52/520; 52/531; 52/551; 52/553; 52/554; 428/189; 156/71

(58) Field of Classification Search ..... 52/98, 52/408, 409, 410, 411, 412, 413, 478, 518, 52/519, 520, 521, 524, 526, 531, 539, 540, 52/541, 543, 544, 545, 546, 547, 551, 553, 52/559, 741.4, 748.1, DIG. 16; 428/33, 53, 428/54, 57, 189, 190, 191, 343, 354; 156/71, 156/290, 291, 574

See application file for complete search history.

(56) References Cited

U.S. PATENT DOCUMENTS 632,825 A * 9/1899 Redick ..... 52/539
652,150 A * 6/1900 Terpening ..... 52/539
1,083,243 A * 12/1913 Edwards, Jr. ..... 52/539
2,831,218 A * 4/1958 Stark ..... 52/539
3,505,770 A * 4/1970 Bennett ..... 52/309.13
5,095,068 A * 3/1992 Chiu ..... 524/525
5,822,943 A * 10/1998 Frankoski et al. ..... 52/518
6,397,546 B1 * 6/2002 Malarkey et al. ..... 52/555
6,494,010 B1 * 12/2002 Brandon et al. ..... 52/578
6,510,664 B2 * 1/2003 Kupczyk ..... 52/528
6,874,289 B2 * 4/2005 Koch et al. ..... 52/543
6,933,037 B2 * 8/2005 McCumber et al. ..... 428/143
2004/0148896 A1 * 8/2004 Koch et al. ..... 52/543
2004/0221536 A1 * 11/2004 Kalkanoglu et al. ..... 52/518
2006/0032174 A1 * 2/2006 Floyd ..... 52/518
2006/0265990 A1 * 11/2006 Kalkanoglu et al. ..... 52/518

* cited by examiner

*Primary Examiner*—Robert J Canfield
*Assistant Examiner*—Matthew J Gitlin
(74) *Attorney, Agent, or Firm*—Malin Haley DiMaggio Bowen & Lhota, P.A.

(57) ABSTRACT

A top down trap lock shingle system that includes a plurality of identical shingles, each shingle having a bottom layer, an intermediate layer permanently attached to the bottom layer along the intermediate layer top edge forming a pocket between the bottom layer and the intermediate layer and a top layer permanently attached to said intermediate layer and permanently attached to said top edge of said bottom layer forming an extended tab along the top of the shingle that includes strips of adhesive and said bottom layer having an enlarged nailing or stapling zone that extends beyond the bottom edge of the intermediate layer, said attachment flange including a top adhesive layer and a bottom adhesive layer. The shingles are trapped and locked by inserting the top tab portion of the top area in a top down manner onto an above shingle row staggered to protect the seams and fastening the bottom edge of the shingle to the plywood roof thus trap locking each of the shingle rows in place. The laminated shingle system is especially durable and protectful against high winds preventing wind damage and water intrusion.

6 Claims, 4 Drawing Sheets

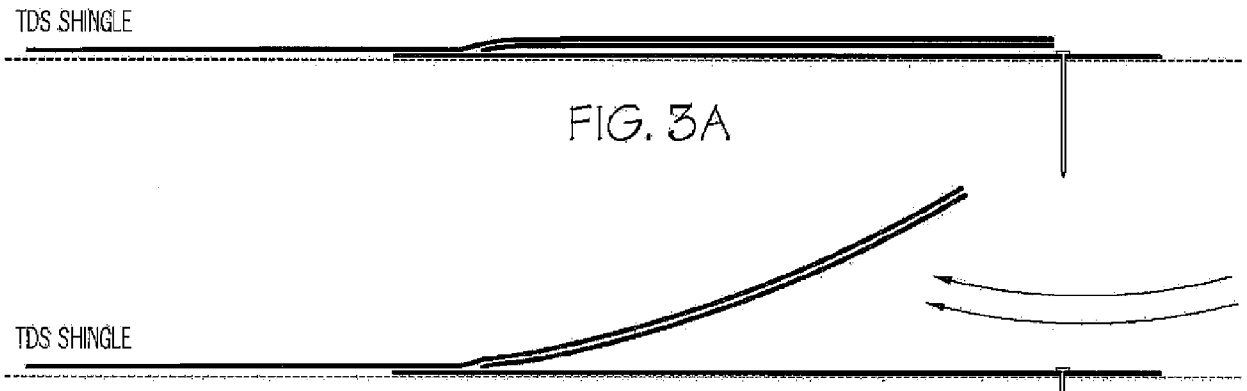
FIG. 3A
FIG. 3B
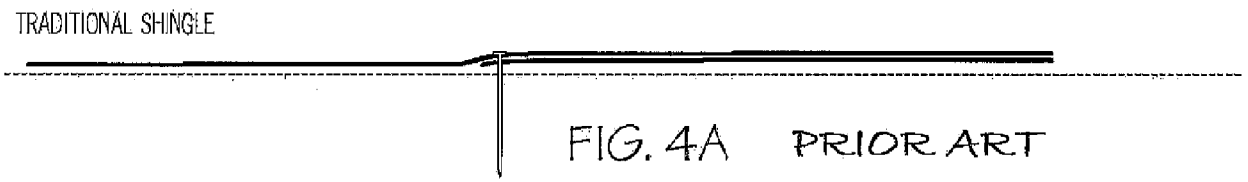
FIG. 4A PRIOR ART
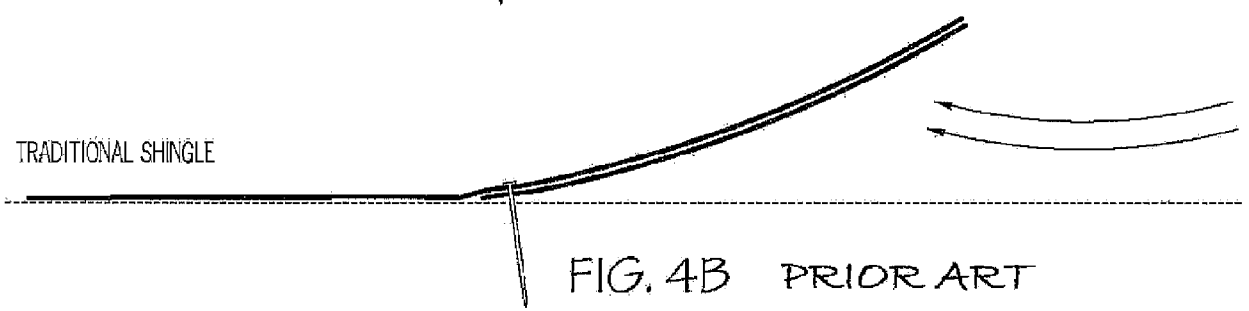
FIG. 4B PRIOR ART

TOP DOWN TRAP LOCK SHINGLE SYSTEM FOR ROOFS

BACKGROUND OF THE INVENTION

1. Field of the Invention

This invention relates generally to protective and aesthetic roofing shingles that cover the roof of a building and, specifically, to a laminated roofing shingle that is durable in high winds and heavy rains. Each shingle has a top insert area and a bottom edge trap lock recess area that receives the top insert area of a lower shingle. The shingles are installed in rows from the top of a roof peak in a downward direction.

2. Description of Related Art

Shingles are known in the art and are made from asphalt, fiberglass, a composite material or any combination thereof roofing materials. The shingles are typically attached to the roof starting from the bottom of the roof edge. The shingles are fastened to the roof in rows with the next row overlapping the lower row. The shingles are secured to the roof typically with nails or staples. Also, adhesives may be used in various areas in the shingle construction. Many of the shingles are laminated and are connected together by an adhesive. Publication U.S. 2006/0265990 shows a laminated shingle made of asphalt.

One of the primary purposes of roof shingles is to protect the roof area from water intrusion caused by rain. High winds often damage roof shingles by lifting and bending increasing water intrusion. One of the techniques in applying shingles is overlapping adjacent shingles so that the areas where the nails or staples fasten the shingle to the roof overlap. Water runs downwardly from the roof top without penetrating the areas where there are nail or staple fasteners. Typically, a roof will also have another water barrier layer below the shingles such as tar paper to protect the roof.

The roofing shingle system described herein provides for a different shingle structure and a different method of attaching the shingles to a roof structure to greatly increase the structural integrity and durability of the shingle system even in high winds to prevent water intrusion.

SUMMARY OF THE INVENTION

A shingle comprising a base layer, an intermediate layer spaced and strategically joined by adhesive to an upper portion of said base layer and a top layer that extends from the base of the intermediate layer well beyond the top of the intermediate layer. The bottom layer has an extended strategically sized area or zone for applying fasteners such as nails or staples along its lower base edge. The shingle has a trap lock recess area that receives the top edge portion of an adjacent lower shingle. Thus, a lower shingle has a top layer for securing the lower shingle to the shingle above. Each shingle includes additional adhesive areas for securely fastening rows of shingles in a top down procedure to the roof surface. By trap locking adjacent rows of shingles, the shingle system has more structural durability and integrity against wind damage to prevent water intrusion.

The top down procedure requires that the first row of shingles be placed at the top of the roof area. A ridge cover at the top of the roof on each side includes a shingle having the trap lock recess to receive the top edge of the lower row of shingles. Subsequent rows of shingles are then fastened below the preceding row of shingles and are inserted into a trap lock recess area formed in the above shingle by the base layer and the intermediate and top layers of each shingle.

Each shingle includes a cutout pattern alternating in tabs and cutouts laterally of the top layer.

One of the important features of the present shingle system is its dramatic increased resistance to wind uplift. The present system also is believed to reduce the number of fasteners required and can also increase the reveal from certain standard areas to larger areas allowing a roof to be covered more quickly, reducing installation time.

The shingle base layer has a wide extending band along the bottom edge that receives fasteners and is called the fastener attachment flange or hem. The fasteners used are typically nails or staples but could be any other suitable fastener. The upper area of the base layer is covered by the intermediate (second) layer and includes a trap lock recess area and an adhesive area. The base layer upper top area along the adhesive area is adhesively fastened to the intermediate layer above. But the bottom portion of the intermediate layer is not fastened to the base layer to allow a trap lock recess area that has sufficient space for receiving the top layer of a shingle positioned below this specific shingle.

When fastening the rows of shingles to a roof, working from the top of the roof downwardly, each next row of shingles is attached by sliding the upper edge of the shingle (which is basically the top layer edge) which has an adhesive band into the trap lock recess area along the lower portion of the above shingle that has already been attached to the roof by fasteners. The fasteners are covered by the lower shingle.

The lower shingle is secured within the trap lock recess area with adhesive and the overlap from the intermediate layer and the top layer. Fasteners are then applied to the fastener flange or hem along the base of the shingle, firmly attaching the shingle to the roof below the trap lock recess area. Each row of shingles is inserted into the trap lock recess to the above row along its top edge and fastened along its base.

It is an object of this invention to provide a shingle system that provides for applying the shingles in rows in a top down process from the top of the roof causing each of the subsequent shingles to be securely fastened in a trap lock recess area and joined with adhesive and fasteners.

It is another object of this invention to increase shingle durability inspite of high winds, reduce the number of fasteners, and increase the reveal to a larger area allowing the roof to be covered more quickly reducing installation time.

In accordance with these and other objects which will become apparent hereinafter, the instant invention will now be described with particular reference to the accompanying drawings.

BRIEF DESCRIPTION OF THE DRAWINGS

FIGS. 3A and 3B show a schematic diagram in a side elevational view of a shingle in accordance with the present invention and the effect of wind.

FIGS. 4A and 4B show a schematic diagram in a side elevational view showing a traditional shingle as it is altered by wind.

PREFERRED EMBODIMENT OF THE INVENTION

Figure 1:
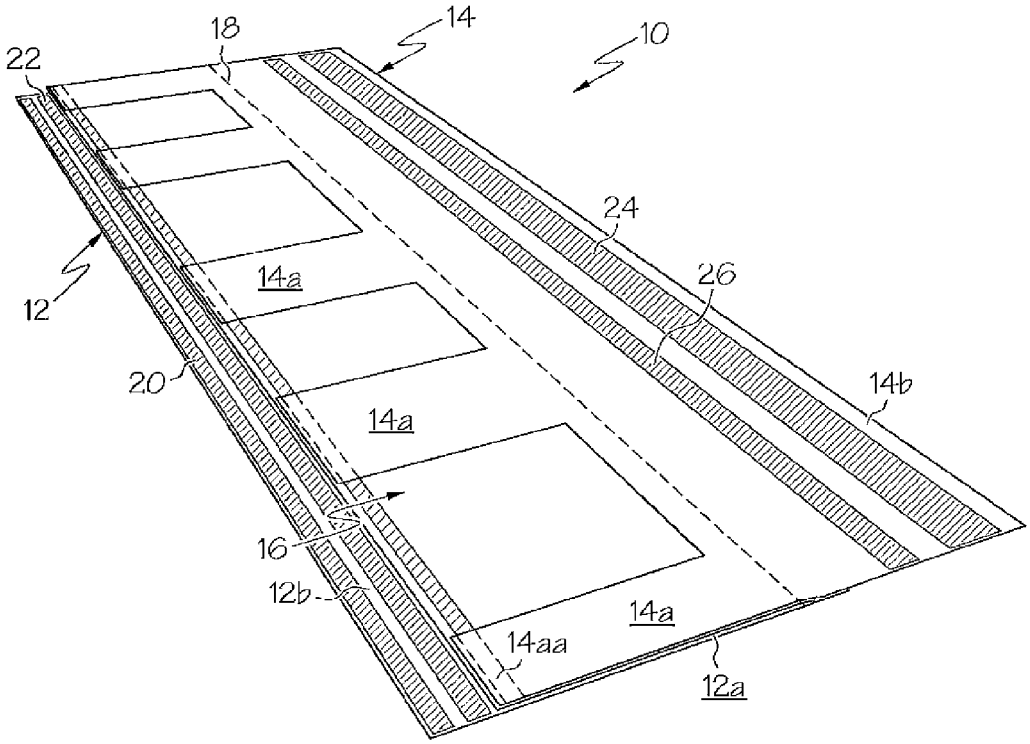
FIG. 1 shows a perspective view of a shingle according to the shingle system described herein.
Figure 2:
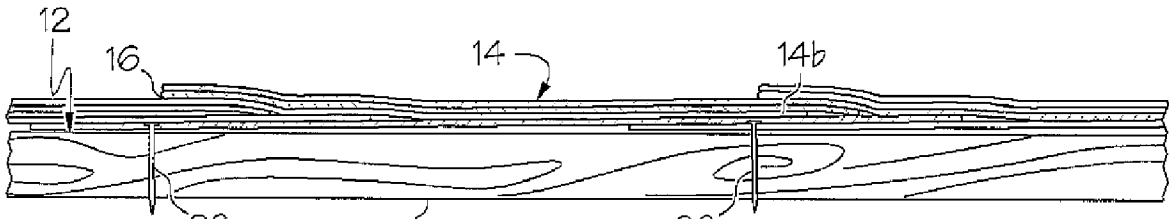
FIG. 2 shows a side elevational view of a group of shingles attached to a roof.

Referring now to the drawings and, in particular, FIG. 1 and FIG. 2, a shingle in accordance with the present invention is shown. The shingle 10 is made of asphalt, fiberglass, a composite material or any combination thereof and is comprised of three separate, relatively thin, somewhat flexible, layers formed in a laminate and glued together or heat sealed together as described herein. The shingle 10 is comprised of three layers of material 12, 14 and 16. Layer 12 is the base or bottom layer and has sections 12*a* and 12*b* which represent different areas on layer 12. Area 12*b* represents an attachment flange or hem that is used for fastening the shingle to a wooden roof. Layers 14 and 16 do not extend along the base over area 12*b* of the lower shingle area. Note that shingle area 12*b* section also has adhesive band 20 on its underside and an adhesive band 22 on its topside. Adhesive bands and dimensions in this embodiment are shown but not limited to just these areas. Other embodiments can exist wherein adhesive band locations can be changed.

The intermediate layer 16 is covered by top layer 14 in the form of a cutout pattern as shown in FIG. 1. Areas showing the top layer 14*a* are double layers in the section 14*a* overlays areas of intermediate layer 16. However, the pattern that is cutout is to reduce the amount of material used and to give it a distinctive shingle-looking pattern. The top layer 14 itself has areas 14*a* which overlap the intermediate layer 16. Top layer 14 has an upper edge area 14*b* that has two glue strips or adhesive strips 24 and 26 on the below side which allow it to be adhesively fastened along its upper edge area in a trap locked recess portion formed between base layer 12 and the intermediate layer 16 when the shingles are inserted to an above row of shingles.

FIG. 2 shows fasteners 28 such as nails that are nailed into a two by four or plywood 30 along a certain attachment flange area of the base layer 12. However, a second shingle is shown having a top edge 14*b* that has been inserted between bottom layer 12 and intermediate layer 16 in an above row shingle causing the lower shingle to be wedged or trap locked into the above shingle along its top edge portion. As shown in FIG. 1, with the glue strips 24 and 26 on the bottom side of top layer 14, when the top layer is in the recess area between bottom layer 12 and intermediate layer 16, the adhesive firmly attaches the layer 14 to the lower shingle. The fasteners 28 along area 12*b* in FIG. 1 firmly secure the base of the shingle to the roof.

Figure 2A:
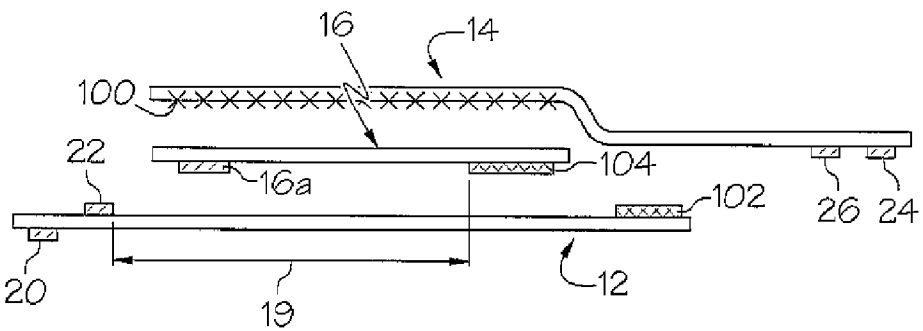
FIG. 2A shows a schematic drawing of an exploded view in a side elevational view of the construction of a shingle in accordance with the present invention.

FIG. 2A shows a schematic diagram of how a single shingle is constructed. The top layer 14 includes a series of "x"s 100 which represent the permanent adhesion boundary line between intermediate layer 16 and top layer 14 which are permanently joined at the factory along line 100. In addition, the intermediate layer 16 is permanently connected to bottom layer 12 along the "x"s 104. This could be either heat sealing or adhesive applied in the factory so that intermediate layer 16 along its top edge is connected to layer 12. This forms the trap lock recess 19 that extends from the permanent adhesion 104 between intermediate layer 16 and lower layer 12 as an opening or recess cavity 19 that allows a lower shingle to be inserted partially into the trap lock cavity 19. In addition, the bottom layer 12 is permanently attached to the top layer 14 along adhesion 102.

The bottom edge of intermediate layer 16 includes a glue strip 16*a* on its underside to secure area 16 to the top of a shingle area 14*b* as the shingle area is inserted from below up into the trap lock recess area 19. The other glue strips are shown including the upper glue strips 20 and 22 on the upper surface of bottom layer 12 and the glue strips 24 and 26 while on the bottom side or the underside of top layer 14. Of course, other glue strips can be added on the upper or lower underneath surfaces for greater adhesion throughout the entire process.

Note that the bottom layer 12 is permanently bonded to top layer 14 near the registration line 18 that forms the trap lock insert area.

The construction of shingle 10 and its use with other shingles in rows dramatically increase durability and the resistance to wind uplift.

Referring now to FIG. 3A, FIG. 3B and FIGS. 4A and 4B, a comparison of a traditional shingle as shown in FIGS. 4A and 4B is made with the present invention as shown in FIGS. 3A and 3B. With the traditional shingle in FIG. 4A, nailed at its top, the wind lifts the shingle like a lever. When looking at the shingle in FIG. 3A and FIG. 3B, it is noted that the upper part of the shingle that is lifted completely away from the area where the fasteners are along the bottom attachment flange shingle. FIGS. 4A and 4B show a conventional shingle that is typically nailed at the top such that the wind indicated by the arrows lifts the shingle up and acts as a lever arm pulling mechanically up on the nail fastener. This cannot happen with the shingle in accordance with the present invention.

Figure 5:
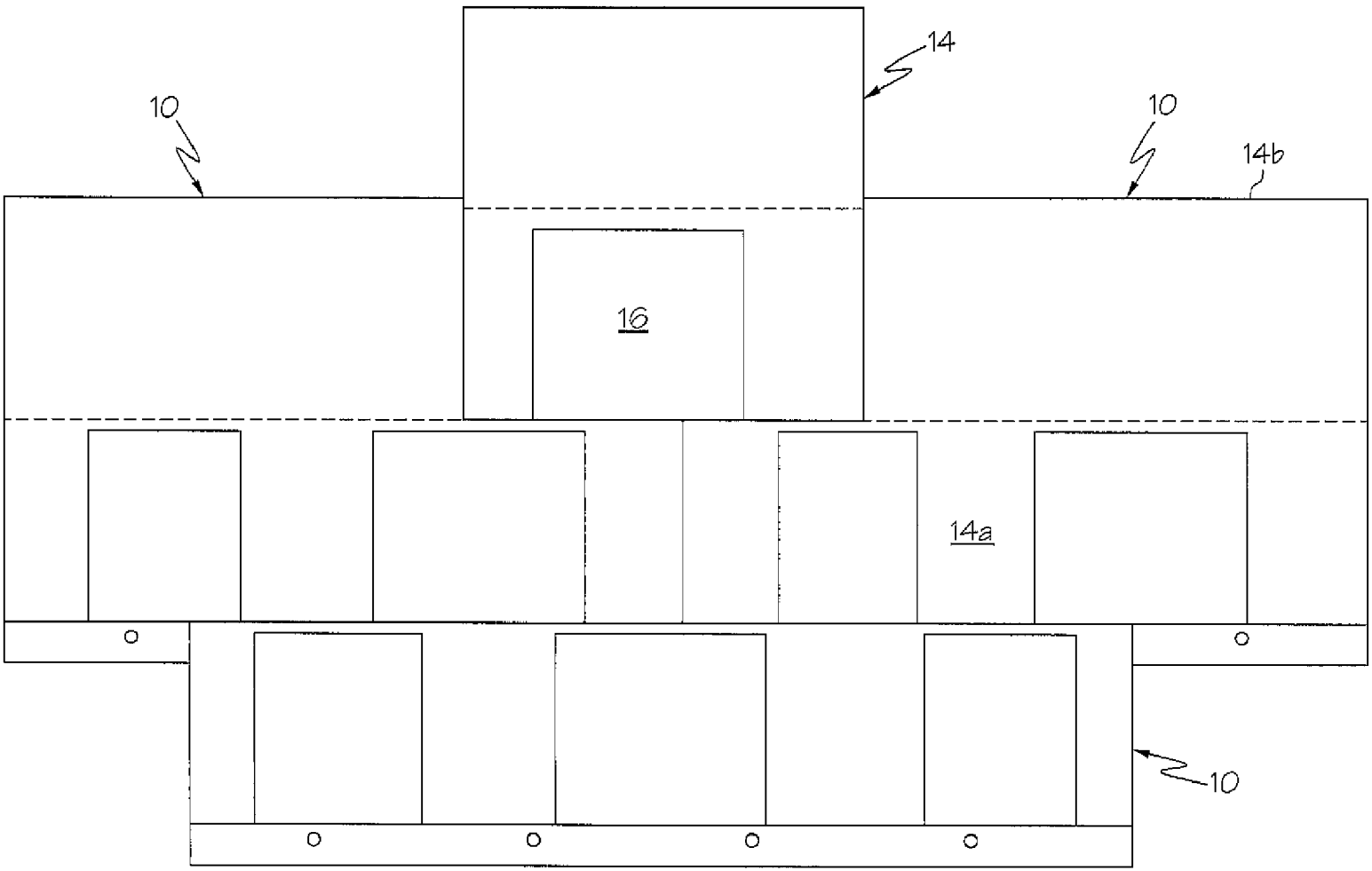
FIG. 5 shows a top plan view of a plurality of shingles connected together in accordance with the present invention.

Referring now to FIG. 5, an array of individual shingle panels or shingles, each of the same size, except the top panel is shown as they would be installed in rows on a typical plywood roof. Using the present invention, the top row of shingle panels would be attached at or near the roof line to a ridge cover having a trap lock recess area. The process would be to add the next row of shingles from the top down by inserting the upper tab portion of the shingle 14 into the pocket or recess of the above row of shingles. The seams on the right are done in overlapping fashion so that the new row of shingles would be staggered laterally so that the adjacent row of shingles would cover the above seam. The vertical length of each shingle is constructed so there is sufficient overlap on the lower panel to prevent any seam exposure or water intrusion along the seam area. Each of the shingles has a registration line 18 as shown in FIG. 1 that is used to ensure that the lower row of shingles is firmly inserted into the pocket in the trap lock formation so that the indicator line 18 is not visible to the installer when the shingles are properly installed.

Referring back to FIG. 1 and FIG. 2, the upper tab portion 14*b* of a shingle is shown inserted between the upper two laminate layers, the top layer 14 and the intermediate layer 16. The bottom layer 12 has been fastened into a two by four or plywood as shown in FIG. 2.

The adhesive strips or bands on shingle 10 are very important for normal locking and trap locking each row of shingles to the row of shingles above along with the attachment flange. Each shingle, as shown in FIG. 1, has two strips of adhesive 24 and 26 which are on the underside of tab 14*b* which is the upper top edge of the shingle and of the top layer of the laminate. This tab edge fits securely in and on top of the upper row of shingles in the pocket formed between intermediate layer 16 and the base layer 12 that is substantially deep enough or long enough to receive a tab 14*b* portion of the lower shingle including the adhesive bands 24 and 26 allowing the tab portion of the shingle to be firmly glued to the bottom layer 12 which itself is fastened along the attachment flange at its bottom edge 12*b*. Again, the fastening flange has adhesive bands, one facing upwardly and the other 20 facing downwardly on the underside. The upper adhesive band or strip 22 thus becomes glued to the tab upper edge of a lower shingle. The attachment flange 12*b* is glued to the roof surface.

Looking at FIGS. 1 and 2, it is evident that when the shingles are inserted into the trap lock pockets row by row in conjunction with the adhesive strips and fasteners, the structural durability and integrity of the shingle is extremely strong against high winds from deforming the shingles or exposing the shingles to water intrusion. Using the trap lock recess pocket in conjunction with the adhesives, the top down roof system made with the shingles is very resistant to wind and water intrusion.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A laminated adhesive shingle for use in a roof system comprised of rows of shingles comprising:

a base layer including an attachment flange, an intermediate layer sized in vertical length so that the intermediate layer does not completely overlap the base layer but allows said attachment flange to be exposed along the bottom of the base layer, said intermediate layer permanently attached along its top edge to said base layer while forming a pocket recess between the top edge of the intermediate layer and the bottom of the base layer, said pocket recess sized to receive a single layer of a shingle; and a top layer attached to said intermediate layer and permanently attached along its mid section to the top edge of said base layer, said top layer extending along the top edge of said base layer forming a top layer single layer band along the top of the shingle; and said top layer single layer area along the top of the shingle and sized in length to fit securely into the pocket recess formed between the intermediate layer and the bottom of the base layer when the shingles are interlocked and trap locked between adjacent rows when installed on a roof.

2. A shingle as in claim 1, wherein:

said top layer including at least one adhesive band on its lower side.

3. A shingle as in claim 1, wherein:

the bottom of the base layer having a top adhesive band exposed along its bottom edge that is not covered by the intermediate layer and an adhesive zone on its bottom side along the bottom edge of said base layer.

4. A shingle as in claim 1, where:

said base layer, said intermediate layer and said top layer are made of an a composite material.

5. A shingle as in claim 1, where:

said base layer, said intermediate layer and said top layer are made of an asphalt material.

6. A shingle as in claim 1, wherein:

said top layer extending approximately one-third the distance along the top edge of said base layer forming a top layer single layer band along the top of the shingle.

* * * * *